US005824121A

United States Patent [19]

Kowoll

[11] Patent Number: 5,824,121

[45] Date of Patent: Oct. 20, 1998

[54] APPARATUS FOR THE PRESSURE GASIFICATION OF FINELY DIVIDED FUELS

[75] Inventor: Johannes Kowoll, Bochum, Germany

[73] Assignee: Krupp Koppers GmbH, Essen, Germany

[21] Appl. No.: 531,032

[22] Filed: Sep. 20, 1995

[30] Foreign Application Priority Data

Oct. 28, 1994 [EP] European Pat. Off. ..... 94117069

[51] Int. Cl.[6] ..... C10J 3/20; C10J 9/04

[52] U.S. Cl. ..... 48/85; 48/102 A; 422/207; 422/208; 422/224

[58] Field of Search ..... 48/197 R, 198.3, 48/198.8, DIG. 1, 102 A, 85; 208/48 Q; 422/207, 208, 224

[56] References Cited

U.S. PATENT DOCUMENTS

| | | | |
|---|---|---|---|
| 3,227,527 | 1/1966 | Heinze et al. | 48/198.3 |
| 3,232,726 | 2/1966 | Eagle et al. | 48/198.3 |
| 3,250,601 | 5/1966 | Jenny | 48/198.8 |
| 3,414,247 | 12/1968 | Sama | 48/198.3 |
| 4,279,622 | 7/1981 | Jones et al. | 48/197 R |
| 5,106,590 | 4/1992 | Hopper et al. | 422/198 |
| 5,464,597 | 11/1995 | Tang | 423/210 |

FOREIGN PATENT DOCUMENTS

| | | |
|---|---|---|
| 0 171 351 | 2/1996 | European Pat. Off. . |
| 38 08 729 A1 | 10/1989 | Germany . |
| 39 41 591 A1 | 6/1991 | Germany . |
| 43 10 447 A1 | 3/1993 | Germany . |
| 93 06 050.5 U | 8/1993 | Germany . |
| 777325 | 6/1957 | United Kingdom . |

*Primary Examiner*—Nina Bhat
*Attorney, Agent, or Firm*—Herbert Dubno

[57] ABSTRACT

A gasification reactor has a mixing tube above it in a common pressure vessel and the mixing tube is provided with a gas cooling heat exchanger. A driving gas feeder draws a portion of the mixture of quenching gas and raw gas from the mixing tube, passes it through the gas cooling heat exchanger and feeds it as a quenching gas to the raw gas at the inlet side of the mixing tube. At least one further heat exchanger in the same pressure vessel or in another pressure vessel, receives the mixture of raw and quenching gas beyond the mixing tube.

9 Claims, 2 Drawing Sheets

APPARATUS FOR THE PRESSURE GASIFICATION OF FINELY DIVIDED FUELS

SPECIFICATION

1. Field of the Invention

The present invention relates to an apparatus for the pressure gasification of finely divided fuels in the production of a product gas and, more particularly, to an apparatus which comprises a gasification reactor, a quenching unit receiving the raw gas outputted by the gasification reactor and one or more heat exchangers downstream of the quencher.

2. Background of the Invention

In pressure gasification of finely divided fuels, namely, solid and liquid fuels, to generate a product gas, it has been proposed (see German Patent Document 43 10 447) to provide a gasification reactor which is followed by a quencher and one or more heat exchangers.

The quenching apparatus can be a mixing tube for mixing the raw gas with a quenching gas.

The quenching gas cools the raw gas to a temperature at which entrained molten slag particles tend to solidify so that they cannot create detrimental deposits but rather are removed from the raw gas stream. The heat exchangers mentioned generally are radiant heat exchangers and/or convective heat exchangers. The apparatus has usually been operated in the past under conditions in which the quencher reduces the temperature of the raw gas to a temperature of about 850° C.

In the apparatus of German Patent Document 43 10 447 the mixing tube of the quencher can be disposed ahead of or downstream of a radiant heat exchanger.

The quenching gas can be a portion of the cooled product gas which is drawn in by injectors and, in turn, can function as a drive gas for displacing the gases emerging from the convective heat exchanger. It is known from U.S. Pat. No. 3,963,457, moreover, to branch off a portion of the cold clean product gas downstream of a gas scrubber and to feed this portion with the aid of a compressor to the gasification reactor in which it is mixed with the raw gas as a quenching gas. The plant is relatively complex and expensive to construct and, from an energy point of view, can be improved.

OBJECTS OF THE INVENTION

It is, therefore, the principal object of the present invention to provide an improved apparatus for gasification of finely divided fuels whereby drawbacks of earlier systems are avoided.

More specifically, it is an object of the invention to provide an improved apparatus for gasification in which the quencher is simplified.

Still another object of the invention is to provide an apparatus of the type described which nevertheless can reduce the energy requirements.

SUMMARY OF THE INVENTION

These objects and others which will become more readily apparent hereinafter are attained in accordance with the invention by surrounding the mixing tube with a gas cooling heat exchanger which is provided with a device for feeding a drive gas into a gas cooling heat exchanger. A partial stream of the raw gas mixed with the quenching gas is thus diverted from the gas mixture energizing from the mixing tube and is displaced by the driving gas through the gas cooling heat exchanger to be cooled and introduced into the mixing tube as a quenching gas. In general, the apparatus is so constructed that the gas cooling heat exchanger can concentrically surround the mixing tube. The mixing tube and the gas cooling heat exchanger can be cylindrical, although it is also possible to provide the mixing tube and gas cooling heat exchanger so that they are of square, rectangular or other polygonal cross section as long as they are geometrically similar to one another so that the mixing tube and the gas cooling heat exchanger have parallel walls.

According to a feature of the invention, in the space between the mixing tube and the outer wall of the gas cooling heat exchanger, a plurality of mutually parallel hollow cylindrical heat exchanger walls or partitions can be provided, these partitions being radially spaced from one another and subdividing the mixture of the quenching gas and raw gas into a multiplicity of sheet or layer flows of the gas mixture through the gas cooling heat exchanger. The heat exchanger walls can be membrane walls, tubes or the like.

The means for injecting the driving gas can also surround the mixing tube and can have a multiplicity of circumferentially spaced drive nozzles. The drive stream entraining the quenching gas into admixture with the raw gas can thus distribute itself symmetrically about the axis of the mixing tube. This is also the case for the quenching gas at entry into the mixing tube and in the gas cooling heat exchanger to which the mixture of raw gas and quenching gas is admitted. The mixture can be sent from above into the gas cooling heat exchanger or from below into the latter. It has been found to be advantageous to entrain the mixture of quenching gas and raw gas through the gas cooling heat exchanger from top to bottom, thereby simplifying the discharge of solidified melt particles.

The invention is thus an apparatus for gasification of coal or petroleum products which comprises:

- a gasification reactor receiving a finely divided fuel and discharging a raw gas;
- a quencher connected to the gasification reactor and receiving the raw gas therefrom the quencher comprising:
  - a mixing tube having an inlet end communicating with the gasification reactor and an outlet end,
  - a gas cooling heat exchanger surrounding the mixing tube and traversed by a portion of a quenched gas mixture from the outlet, and
  - means for introducing a driving gas into the gas cooling heat exchanger for inducing flow of the portion of the quenched gas mixture through the gas cooling heat exchanger, cooling of the portion of the quenched gas mixture in the gas cooling heat exchanger, and combination with the drive gas to form a quenching gas which is admitted to the mixing tube to quench raw gas received from the gasification reactor and produce the quenched gas mixture; and
- at least one further heat exchanger connected to the outlet for abstracting heat from at least another portion of the quenched gas mixture to produce a product gas.

The invention is based upon the discovery that the mixing tube of the earlier apparatus can be retained but utilized without difficulties and at especially low cost by surrounding it with the gas cooling heat exchanger in which the raw gas from the mixing tube which has been quenched to a temperature of about 850° C., can be recycled with further cooling to become the quenching gas introduced into the mixing tube at the inlet end thereof. The gas cooling heat exchanger is capable of cooling the recycled gas mixture to a sufficiently low temperature for the quenching process. The drive gas can be used to control the quenching process and cooling. According to a feature of the invention, the device for feeding the drive gas can include means for controlling the drive gas flow rate to regulate the proportion of the gas mixture which is to be recycled as the quenching gas to the raw gas and the cooling thereof. Indeed, the drive gas feed means can be provided with a device for recovering product gas for use as the driving gas.

The driving gas feeding device can be provided at the gas inlet to the gas cooling heat exchanger or, preferably, at the gas outlet thereof.

In the gas flow direction, the heat exchanger following the quencher can be provided with a further mixing tube surrounded by a gas cooling heat exchanger, a device for feeding driving gas and a system in which the recycled gas is branched from the mixture of the raw gas and quenching gas. The gasifier and quencher can be provided in a common pressure vessel which can include a further heat exchanger, all disposed one above the other. The apparatus is therefore highly flexible. A further heat exchanger can be provided in a separate vessel if desired as well, the two vessels being connected by a gas line.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
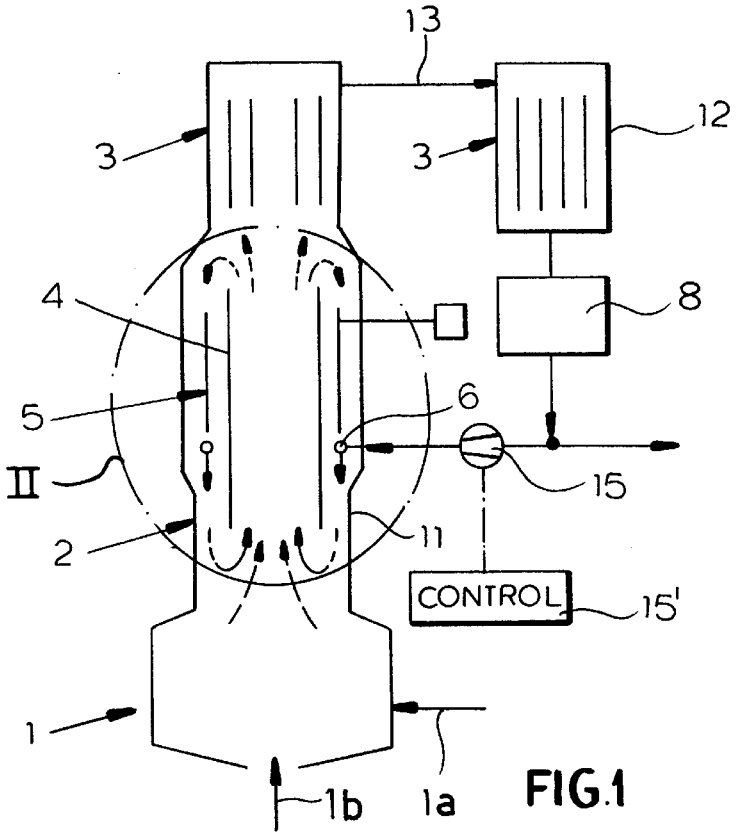
FIG. 1 is a highly diagrammatic sectional view of a gasification apparatus according to the invention.
Figure 2:
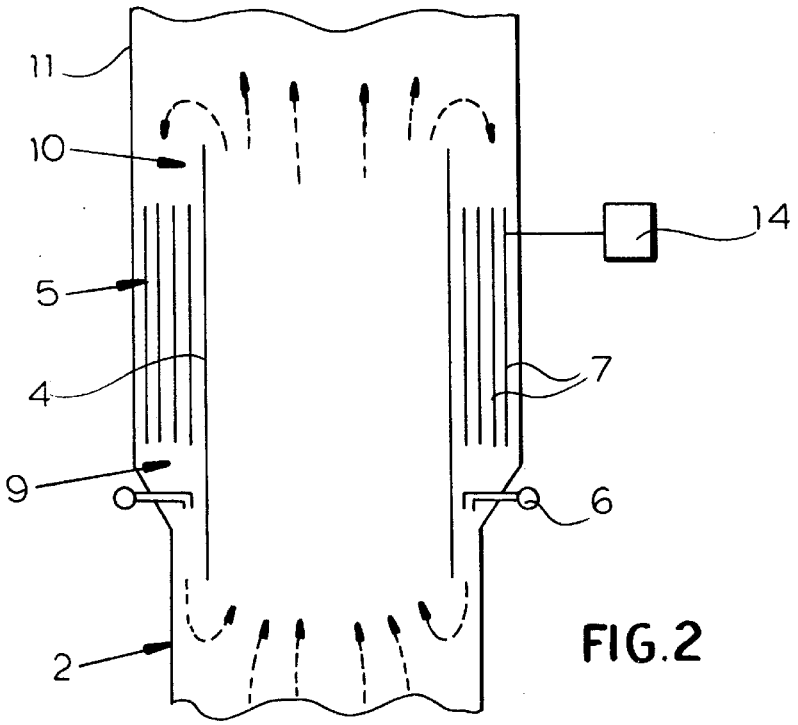
FIG. 2 is a detail of a modified version of the portion shown at II of FIG. 1.

The apparatus shown in FIGS. 1 and 2 is utilized for pressure gasification of finely divided fuels in the production of a product gas therefrom. The apparatus basically comprises a gasification reactor to which the particulate fuel is added at 1*a* and the gasification gas at 1*b*. Downstream of the reactor 1 and, in the embodiment shown, above this reactor is a quenching apparatus 2 for the raw gas discharged by the gasification reactor. The quencher 2 is followed by a plurality of further heat exchangers 3. One of these heat exchangers 3 may be located above the quench apparatus 2 and can be a radiant heat exchanger, for example, the heat exchanger giving up heat to steam to produce superheated steam.

A further heat exchanger 3 in the path of the product gas is a convection heat exchanger 3. The quenching apparatus 2 comprised a mixing tube 4 for the mixing of the raw gas with a quenching gas.

As is also visible from FIGS. 1 and 2, the mixing tube 4 is surrounded by gas cooling heat device 6 for injecting drive gas into the quenching gas so as to feed that quenching gas to the raw gas. More particularly, as shown by the arrows, a peripheral portion of the raw gas mixed with quenching gas and outputted at the upper end of the mixing tube 4 is diverted outwardly and downwardly through the gas cooling heat exchanger 5, is cooled therein, and enters the mixing tube 4 at its bottom or inlet end to quench the raw gas in the mixing tube 5. As can be seen from FIG. 2, the gas cooling heat exchanger 5 comprises a plurality of hollow cylindrical heat exchanger walls or partitions 7 which are spaced radially from one another and distribute the partial flow of raw gas mixed with quenching gas, entering the gas cooling heat exchanger, into respective layers or sheets which flow downwardly. The device 6 can be equipped with a mechanism for controlling the flow of the driving gas, e.g. a controller 15' for the compressor 15, thereby enabling regulation of the rate of flow of quenching gas through the cooling heat exchanger 5 and thus the amount of quenching gas and the amount of cooling of the quenching gas mixed with the raw gas and thus the temperature to which the raw gas is quenched.

While a variety of driving gases may be used, as long as they are compatible with the product gas, in the embodiment illustrated and in a preferred embodiment of the invention, the driving gas feeder is connected to a supply device 8 from which product gas can be directed to the driving gas feeder 6. The driving gas feeder 6 is thus supplied with cooled clean product gas. From the embodiment illustrated in FIGS. 1 and 2, it will also be apparent that the driving gas feeder 6 is located in the region of the gas outlet 9 of the gas cooling heat exchanger. The driving gas feeder may, however, as shown for the feeder 6*a* in FIG. 3, also be located in the region of the gas inlet to the heat exchanger 5. The apparatus can have both a driving gas feeder at the inlet and a driving gas feeder at the outlet if desired.

In the system of FIGS. 1 and 2, the gasification reactor 1, the quenching apparatus 2 and a further heat exchanger 3 are all disposed one above another in a common pressure vessel 11. Downstream thereof is a further pressure vessel 12 for a further heat exchanger 3, the 2 pressure vessels 11 and 12 being interconnected by the gas line 13.

The quenching apparatus 2 and the device 6 for injecting the driving gas into the cooler 5 provide a compact construction in which pressure and energy losses are extraordinarily small, involving only the pressure drop in the mixing tube 4 and the pressure drop in the gas cooling heat exchanger 5 to be overcome by the energy supplied.

Sticky slag particles which are entrained in the raw gas solidify in the mixing tube 4 and prior to entry into the gas cooling heat exchanger. Erosion phenomena which can be produced by particles entrained in the quenching gas seldom occur and are relatively minor since these gases travel at comparatively low speeds. While deposits can form on the heat exchanger walls 7, these can be removed by hammering, vibration or soot blasting techniques as represented by the hammer unit 14 connected to the walls 7, the loosened deposits passing from the gas cooling heat exchanger without hinderance.

With the apparatus of the invention the heat can be abstracted from the product gas and quenching gas at comparatively high temperatures and thus with relatively small heat exchange surface areas so that the gas cooling heat exchanger 5 can be comparatively compact. To supply the driving gas a compressor 15 of comparatively low power can be used. In the mixing tube 4 a substantially uniform gas temperature in the range of 600° C. to 1300° C. can be achieved with the entrained molten particles being solidified. The quenching gas passes out of the gas cooling heat exchanger at a temperature of 200° to 900° C. and is supplied to the mixing tube 4 together with the driving gas. The optimum speed of the gases in mixing tube 4 and the gas cooling heat exchanger 5 is 6 to 10 m/s. The speeds can, however, lie within the relatively broader range of 3 to 20 m/s. The driving gas should have significantly higher speed, say, 40 m/s to the speed of sound. With increasing speed, the driving gas volume rate of flow can be reduced.

Figure 3:
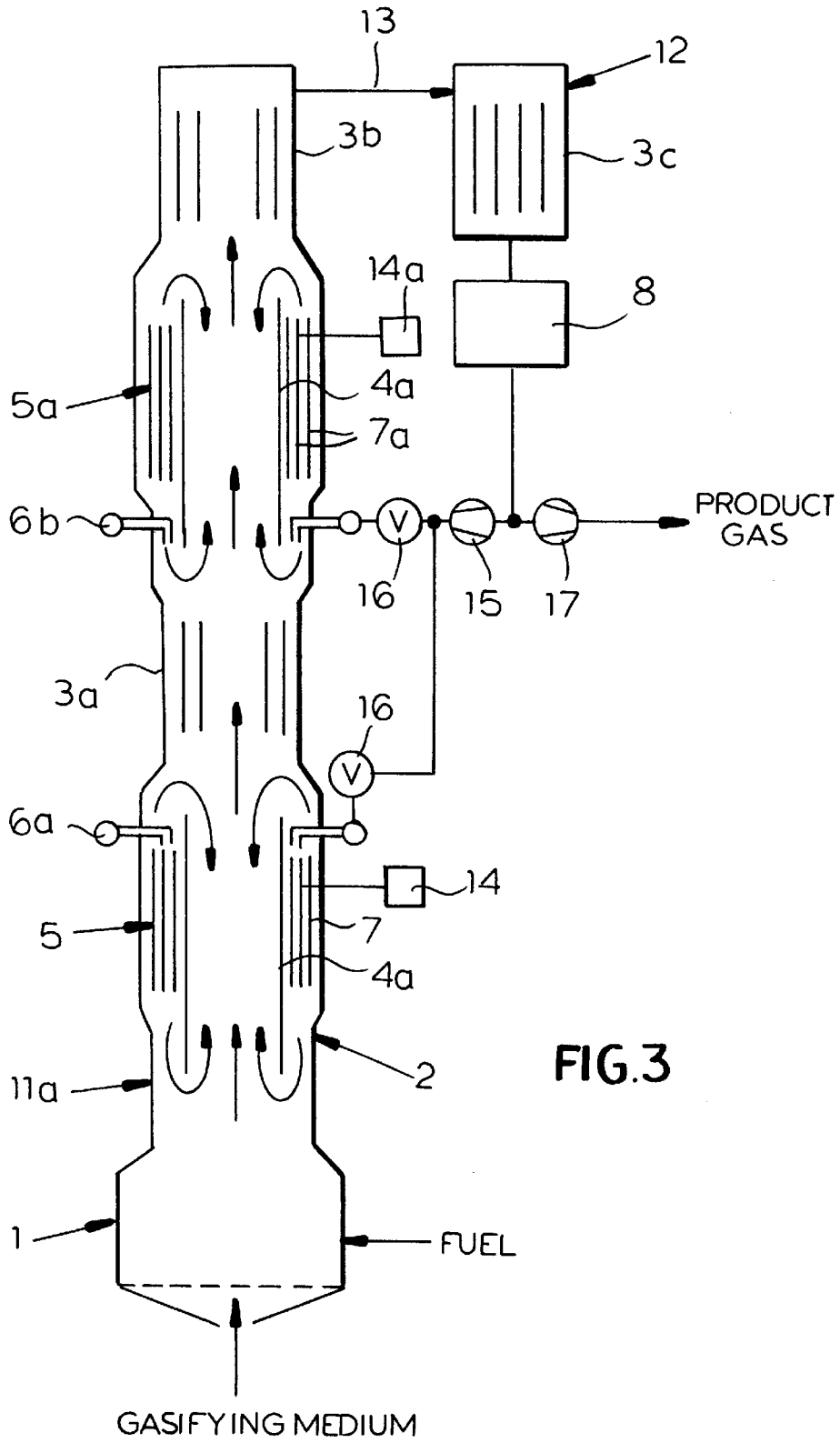
FIG. 3 is a view similar to FIG. 1 of another embodiment of the apparatus.

In the apparatus of FIG. 3, the gasification reactor 1 is provided in a single pressure vessel 11*a* with the quencher 2 having the driving gas unit 6*a* at the upper end of its heat exchanger 5, a further heat exchanger 3*a,* and another mixing tube 4*a* surrounded by a gas cooling heat exchanger 5*a* with partitions 7*a*. The driving gas feeder 6*b* is here disposed at the lower end of this annular heat exchanger.

Hammers 14 and 14*a* dislodge deposits from the plates 7 and 7*a*. Above the mixing tube 4*a* another heat exchanger 3*b* is provided and the output is delivered from line 13 to the second pressure vessel 12 which contains the heat exchanger 3*c,* producer gas being connected at 8. A compressor 17 discharges the usable portion of the product gas at 17 while the recycled portion of the product gas is fed by the compressor 15 through the valve 16 to the feeders 6*a* and 6*b*. Except for the added tube 4*a* and its gas cooling heat exchanger, the apparatus of FIG. 3 operates similarly to the apparatus of FIG. 1.

I claim:

1. An apparatus for pressure gasification of a finely divided fuel, said apparatus comprising:

a gasification reactor receiving a finely divided fuel and discharging a raw gas;

a quencher connected to said gasification reactor and receiving said raw gas therefrom said quencher comprising:

a mixing tube having an inlet end communicating with said gasification reactor and an outlet end, a gas cooling heat exchanger surrounding said mixing tube and traversed by a portion of a quenched gas mixture from said outlet, and means for introducing a driving gas into said gas cooling heat exchanger for inducing flow of said portion of said quenched gas mixture through said gas cooling heat exchanger, cooling of said portion of said quenched gas mixture in said gas cooling heat exchanger, and combination with said drive gas to form a quenching gas which is admitted to said mixing tube to quench raw gas received from said gasification reactor and produce said quenched gas mixture;

at least one further heat exchanger connected to said outlet for abstracting heat from at least another portion of said quenched gas mixture to produce a product gas;

a flow cross section of said mixing tube and a flow cross section of said gas cooling heat exchanger being so dimensioned as to sustain gas velocities therein in a range of 3 to 20 m/g, said means for introducing said driving gas being so operated as to create a gas velocity at an inlet to said gas cooling heat exchanger in excess of 40 m/s; and means for controlling a flow rate of said driving gas thereby regulating the portion of said quenched gas mixture passed through said gas cooling heat exchanger and the cooling of the raw gas to a quenching temperature.

2. The apparatus defined in claim 1 wherein said gas cooling heat exchanger and feed mixing tube are concentric with one another.

3. The apparatus defined in claim 1 wherein said gas cooling heat exchanger is provided with a plurality of cylindrical heat exchanger walls spaced radially from one another and distributing said portion of feed quenched gas mixture into a plurality of cylindrical layer streams.

4. The apparatus defined in claim 1 wherein said means for introducing said driving gas is connected to a source of cooled product gas so that feed driving gas is produced gas outputted from said at least one further heat exchanger.

5. The apparatus defined in claim 1 wherein said means for introducing said driving gas is disposed adjacent an outlet from said gas cooling heat exchanger.

6. The apparatus defined in claim 1 wherein said means for introducing said driving gas is located adjacent an inlet of said gas cooling heat exchanger.

7. The apparatus defined in claim 1, further comprising another mixing tube downstream of said further heat exchanger and, a gas cooling heat exchanger surrounding said other mixing tube and means for introducing a driving gas into the gas cooling heat exchanger surrounding said other mixing tube.

8. The apparatus defined in claim 1 wherein said gasification reactor and the quencher are provided in one pressure vessel and said at least one further heat exchanger is provided in another pressure vessel connected to the first mentioned pressure vessel by a pipeline.

9. The apparatus defined in claim 1, further comprising at least one additional heat exchanger connected to said outlet abstracting heat from at least another portion of said quenched gas mixture.

* * * * *